US005538409A

United States Patent [19]

Cureton et al.

[11] Patent Number: 5,538,409

[45] Date of Patent: Jul. 23, 1996

[54] TROCHOIDAL PISTON SIDE SEAL

[75] Inventors: George K. Cureton, Croydon; Jacek Walter, Nunawading, both of Australia

[73] Assignee: Scalzo Automotive Research Limited, Victoria, Australia

[21] Appl. No.: 245,432

[22] Filed: May 18, 1994

[30] Foreign Application Priority Data

May 19, 1993 [AU] Australia ..... PL8849

[51] Int. Cl.[6] ..... F01C 19/08

[52] U.S. Cl. ..... 418/142; 418/144; 277/143

[58] Field of Search ..... 418/141, 142, 418/144; 277/138, 141, 143

[56] References Cited

U.S. PATENT DOCUMENTS

| | | | |
|---|---|---|---|
| 2,935,053 | 5/1960 | Brueder . | |
| 2,949,905 | 8/1960 | Brueder . | |
| 2,988,065 | 6/1961 | Wankel et al. . | |
| 2,988,070 | 6/1961 | Brueder . | |
| 2,988,409 | 6/1961 | Fuhrman | 277/141 |
| 3,046,069 | 7/1962 | Schmidt | 418/142 |
| 3,103,208 | 9/1963 | Price et al. . | |
| 3,131,379 | 4/1964 | Holt . | |
| 3,154,061 | 10/1964 | Biabaud . | |
| 3,185,386 | 5/1965 | Peras | 418/142 |
| 3,253,582 | 5/1966 | Ortlieb . | |
| 3,266,468 | 8/1966 | Peras . | |
| 3,309,011 | 3/1967 | Osakada et al. | 418/142 |
| 3,410,254 | 11/1968 | Huf . | |
| 3,444,852 | 5/1969 | Biabaud . | |
| 3,465,613 | 9/1969 | Biabaud . | |
| 3,881,848 | 5/1975 | Huf | 418/123 |
| 3,905,730 | 9/1975 | Ruf | 418/142 |

FOREIGN PATENT DOCUMENTS

| | | |
|---|---|---|
| 1024504 | 3/1966 | United Kingdom . |
| 1042722 | 9/1966 | United Kingdom . |

*Primary Examiner*—Charles Freay

*Attorney, Agent, or Firm*—Merchant, Gould, Smith, Edell, Welter & Schmidt

[57] ABSTRACT

A piston side seal for a multi-lobed piston of a trochoidal rotary engine, consisting of an elongate, resilient metal seal member in the form of a ribbon having first and second opposed side edges wherein in use, the first edge is adapted for lateral location in a seal groove of a multi-lobed trochoidal piston and the second edge will face and provide a seal with a side plate surface of an engine housing when a force is applied to urge said seal member outwardly with respect to the groove, and characterized in that the seal member is provided with at least one longitudinally extending bevelled surface which faces away from the second edge and is adapted such that when the force is applied to the bevelled surface, the force is resolved into a first component to achieve the sealing of the second edge with the side plate surface of an engine housing and a second component which acts to urge the seal member into engagement with one side of the piston groove to provide a gas seal between the seal member and that one side.

17 Claims, 7 Drawing Sheets

46
C'
C
37
38
36
34b
34a
40
43
42
44
24
44b
44a
X
45b
45
26
45a

TROCHOIDAL PISTON SIDE SEAL

FIELD OF THE INVENTION

The present invention relates to piston side compression seal for a trochoidal piston rotary engines.

BACKGROUND OF THE INVENTION

Rotary piston engines of the type for which the side seal of the present invention is intended have a multi-lobed piston rotatably mounted on a crankpin of a crankshaft, with the crankshaft rotatably mounted in a housing. The multi-lobed piston has the shape of a trochoid or of a curve inside and parallel to a trochoid, while the housing has an inner surface shape corresponding respectively to the outer enclosing curve, or outer envelope, of the trochoid or of the inside parallel curve, these alternatives hereinafter being encompassed by reference to "trochoid" or the "outer enclosing curve, or envelope" thereof. Rotational phasing of the piston relative to the shaft and the housing is ensured by an external gear which is fixed to the piston end which meshes with an internal gear fixed to the housing. The trochoid has at least two lobes and, theoretically it can have any greater number of lobes. The number of lobes determines the gear ratio required for phasing and also the number of working chambers in the housing; the number of such chambers being equal to the number of lobes plus one. Thus a family of trochoidal piston rotary engines exists. The present invention is particularly relevant to a two lobe trochoid rotary piston engine with three working chambers, and the following description largely is directed to two lobes, trochoid shaped piston members. However, the invention extends to engines having more than one piston member and to engines having at least one piston with three or more lobes.

In such rotary piston engines, each working chamber defines or has an associated combustion chamber. It is well known that a major problem is that of sealing the working chambers. This is required so that hot combustion gases do not escape through small but necessary running clearances between each side face of the piston and an adjacent side plate surface of the engine housing, but rather discharge through opening ports or valves. In general, rotary engines have peripheral or apex seals, usually mounted in the housing at apexes, to seal between adjacent working chambers at the outer, peripheral seal of the piston. The engines also have a respective side seal located in a peripheral groove in each side face of the piston, and resiliently biased to rub against and conform to the adjacent side plate surface. The side seal also is intended to conform to a surface of the groove under prevailing gas pressure.

A side seal usually is in the form of an elongate ribbon of rectangular cross-section, and curved and presented sideways into the groove. The side seal is relatively thin to provide low seal friction with the surface of a side plate against which it is biased for sealing engagement, and has a width several times its thickness. Each seal generally is a relatively neat fit within its groove in the piston side face. A longitudinal spring usually is provided in the groove, between the bottom of the groove and the inner edge of the seal, to ensure that the seal is biased against the adjacent side plate surface. Gas pressure, communicated to the inner edge of the seal, provides an additional force acting to urge the seal into sealing engagement with the side plate surface.

The side seal groove in the piston must be positioned sufficiently far inside of the outer periphery or profile of the piston to ensure that a resultant cantilevered land section of the piston, between the groove and the outer periphery of the piston, is wide enough to have adequate structural strength. However, it is also important to keep the width of the land to a minimum. This is because the width of the land and the required running clearance between the piston and the housing side plates define areas, between the side seals and the apex seals, through which gas leakage between adjacent working chambers can occur, even though button seals can be used to minimise the leakage through these areas. In general, it is desirable that the side seal groove is a minimum distance inside of the outer periphery of the piston providing for the structural integrity of the cantilevered land of the piston, and that the groove is curved so as to be substantially parallel to the outer periphery or profile of the piston.

A reciprocating engine relies on compression rings to seal against the bottom of the piston groove as well as against the walls of the cylinder during combustion. Whilst prior art rotary engines allow for the hot compressed gas to get behind the side seals and press the side seals against the side plate surfaces, it can not be ensured that the side seals are pressed against the inner side of their grooves under dynamic conditions. This is particularly so at high speeds, since centrifugal force tends to force the sealing strip outwardly against the combustion pressure. Under these conditions the side seals float between the sides of their grooves and allow gases to escape around them. In addition, the action of rotatory and orbiting motion of the rotary piston tends to act to dislodge the side seals in their trailing ends. This has the consequence of producing a gas leakage path around the flanks of the side seals and thus contributes to low engine performance.

In trochoidal piston rotary engines it has been found in practice that gas pressure is inadequate to force the side seals against the inner side of their grooves. It also is found that substantial sealing against at least one, but preferably each, side of the groove is necessary. It is an object of this invention to provide a side seal enabling this type of sealing.

Specific prior art in producing a seal behind side seals is provided in U.S. Pat. No. 3,881,848 to Huf. In this, a cup-shaped insert is located behind the side seal. However in practice, particularly in applications where the side seal is of small dimensions, of the order of 1 mm thick or smaller, this method is very difficult. In addition, gas is not prevented from reaching the opposite side of the rotor, creating high seal load and preventing the high pressure gas from doing work. Also it does not prevent the gases from escaping along the flanks of the outer side seal.

SUMMARY OF THE INVENTION

A side seal according to a first form of the invention comprises an elongate, resilient metal seal member in the form of a ribbon, the seal member being of substantial width relative to its thickness. The seal member has first and second opposed side edges of which the first edge when in use is the leading edge as the seal member is presented laterally for location in a seal groove of a trochoidal piston, such that the second edge will face a side plate surface of an engine housing when the piston is mounted in the housing. The second edge of the seal member is adapted to provide a seal with the side plate surface under the action of a force is applied to urge the seal member outwardly with respect to the groove. The seal member also defines a longitudinally extending, bevelled surface which faces away from the second edge such that, with a force applied to the bevelled surface, the force is resolved into a first component achieve the sealing of the second edge with the side plate and a second component which acts to urge the seal member into engagement with one side of the piston groove to provide a gas seal between the seal member and that one side.

The bevelled surface may comprise or be adjacent to the first edge of the seal member. Alternatively, the seal member may be laterally stepped along a longitudinal line such that a part of its width from the first edge is thinner than the remainder of its width to the second edge, with a resultant shoulder providing the bevelled surface.

In its as formed condition, the seal member may be flat and bendable so as to conform to the curvature of the piston groove. Alternatively, the seal member as formed may be suitably curved, such as to substantially the curvature of the piston groove. In its in use curved form, the seal member most preferably is adapted to provide a seal with the inner side of the piston groove, i.e. the side of the groove remote from the outer periphery of the piston.

The seal member of the first form of the invention preferably is part of a seal assembly which includes biasing means for biasing the seal member for sealing engagement with both a side plate surface and a side of the groove. In use, the biasing means is provided at or towards the bottom of the piston groove and engages the seal member at its bevelled surface.

The biasing means may simply comprise a suitable spring member, such as an elongate strip member of undulating spring form. The spring member is operable to provide a biasing force for urging the seal member into engagement with a side plate surface. However, by applying that force at the bevelled surface of the seal member, a first component of the force provides that engagement with a second component urging the seal member into engagement with a side of the groove.

In an alternative arrangement the biasing means of the assembly includes a spring member and a cam member. In use, the spring member is provided at or towards the bottom of the groove, with the cam member positioned between the spring member and the bevelled surface of the seal member. In this case, the spring member is operable to provide a biasing force for urging the seal member into engagement with a side plate surface, with the force being transmitted to the seal member through the cam member, and resolved into components at the bevelled surface. There accordingly is relative movement between the cam member and the seal member across the bevelled surface, urging the seal member into engagement with one side of the piston groove and, preferably, urging the cam member into engagement with the other side of the groove.

The spring member for use with a separate cam member can be of any suitable form. Again, it preferably is of elongate, undulating spring form. The cam member is of elongate form which, like the seal member, is either bendable to conform to the curvature of the piston groove or is provided with such curvature. The cam member has respective sides by which it is respectively engaged by the spring member and the seal member, with its side for engaging the seal member being bevelled oppositely so as to be complementary to the bevelled side surface of the seal member.

In a second form of the invention, the side seal of the invention is formed from two elongate strip members each having first and second opposing edges. In use, the two elongate members are receivable as a substantially parallel pair (i.e. a single side seal) into a common piston groove, to provide an outermost elongate member nearer to the outer periphery of the piston and an innermost elongate member. The arrangement is such that when the two elongate members are adjacently positioned they form a ribbon having first and second opposed side edges. In a preferred arrangement the second side edge of each elongate member is adapted to seal against a common side plate surface.

In one embodiment of the second form of the invention, each elongate member may have a longitudinally extending, bevelled surface at or facing towards its first side edge. In one preferred arrangement, the bevelled surface is at the first side edge. In an alternative arrangement, each seal member is stepped intermediate its first and second edges, at a face thereof opposed to the other seal member, with the step defining the bevelled surface. In each arrangement, the bevelled surfaces are oppositely inclined; with the bevelled surface of each seal member being inclined away from the second edge and the other elongate member. The bevelled surfaces together define a groove opening away from the second edge of the seal member.

As with the side seal of the first form, the side seal of the second form preferably is part of an assembly which includes biasing means; the biasing means in the second form being for biasing each of the seal members into engagement with the side plate surface. The biasing means may be similar to that described for the first form of the invention. However, the biasing means is operable, in biasing each seal member for engaging a common side plate surface, to urge the two seal members away from each other so that each engages a respective side of the piston groove.

In a second embodiment of the second form of the invention, the side seal comprises first and second elongate members, each having first and second side edges, with the first elongate member being of greater distance between its side edges than the second member. In use, the elongate members are receivable as a substantially parallel pair into a common piston groove, to provide an outermost elongate member nearer to the outer periphery of the piston and an innermost elongate member. The arrangement is such that the first elongate member, which preferably is the innermost member, is adapted at its second side edge to seal against a side plate surface.

In this form, each elongate member has a longitudinal bevelled surface at or facing towards its first edge. In one preferred arrangement, the bevelled surface is at the first edge. In a second arrangement, each elongate member is stepped intermediate its first and second edges, at a face thereof opposed to the other elongate member, with the step defining the bevelled surface. In each arrangement, the bevelled surfaces are oppositely inclined; with the bevelled surface of each elongate member being inclined away from the second edge and the other elongate member. The bevelled surfaces together define a groove opening away from the second edge of the seal member.

In this form, the first elongate member may have a rib or ridge provided along its face opposed to second elongate member, with the rib or ridge at or adjacent the second side edge of the first elongate member. The rib or ridge has a side surface facing towards the first side edge of the first member, and the second edge of the second member is adapted to abut the side surface of the rib or ridge. The second edge of the second member and the side surface of the rib or ridge preferably are of opposed complementary bevelled form, with the bevelled surface of the rib or ridge inclined similarly to its groove-defining bevelled surface and the bevelled second edge of the second member inclined oppositely to its groove-defining bevelled surface.

As with the side seal of the first form, the side seal of this form preferably is part of an assembly which includes biasing means. The biasing means may be similar to that of the first form. As with the second form, the biasing means is operable in this form to urge the seal members away from each other so that each engages a respective side of the piston groove. However, in contrast the biasing means is operable in this form to bias only the first elongate member into engagement with the side plate surface.

An assembly including a side seal according to the invention is intended to provide sealing around one lobe of a trochoidal piston, at one side face of the piston. In a piston as mounted in its engine housing, there typically will be a respective assembly provided in each side face groove portion extending around each lobe. Particularly in such case, it is desirable that the side seal includes an inter-lobe groove seal (hereinafter referred to as a "groove seal") which substantially prevents gas pressure in its groove portion from being transmitted to a next groove portion, thereby avoiding excessive load and, hence, friction at a lobe which is not subjected to such pressure. That is, in operation, firing occurs in successive working/combustion chambers, and it is required that resultant gas pressure with groove portions of a lobe of the piston involved in a firing is substantially prevented from being transmitted to the groove portion of the or each adjacent lobe.

A groove seal preferably is provided at or adjacent one end of each side seal. The arrangement is such that, with a respective side seal in the groove portion of each lobe of a piston side face, the groove portion of each lobe is substantially isolated from the groove portion of each adjacent lobe around that side face.

In a first arrangement, the groove seal is provided by a bracket (or tag) locatable in a cut-out formed at or adjacent to one end of the seal member, and in a recess defined by a short length of the piston groove portion which is adjacent to a waist of the piston and of greater depth than the remainder of the groove portion. Where the side seal is of the first form, having a single seal member, the cut-out extends inwardly from the first edge of the seal member across a major part of its width. When received in the cut-out, the bracket projects therefrom beyond the first edge, with a resultant projecting portion thereof being receivable, preferably as a friction fit, in the groove portion recess. In the thickness direction of the seal member, the bracket has a thickness such that it is a neat, sealing fit between opposed side faces of the groove, to thereby provide a gas seal in the groove, over a major part of the depth of the groove from its bottom face. Where the seal member is of the second or third form, the arrangement is similar, except that aligned cut-outs are provided in each of the two seal members of the side seal.

In that first arrangement, the bracket prevents movement of the side seal along the groove, due to its inter-fitting with the side seal and locating in the recess. However, the inter-fitting of the bracket and side seal most preferably is such as to accommodate thermal expansion of the seal member.

In a second arrangement, the groove seal is provided by a resilient joiner which fits firmly in the piston groove, and which inter-fits with a cut-out at or adjacent to one end of the side seat; the cut-out (or cut-outs) being such as detailed for the first arrangement. As with the bracket of the first arrangement, the joiner provides a gas seal in the groove, over a major part of the depth of the groove from its bottom face. The joiner most preferably is at a first end of its side seal and such as to enable that end to be closely opposed to the other end of a next side seal. That other end also may be provided with a cut-out with which the joiner inter-fits, such that the opposed ends are closely spaced across the joiner at the opening of the groove.

In a third arrangement, the groove seal is provided by a bracket as in the first arrangement, and a joiner as in the second arrangement. The joiner preferably is at an end of the side seal, with the bracket adjacent to that end, a short distance from the joiner.

The invention also provides a rotary piston engine of the above-described type, having a piston side seal according to the invention.

BRIEF DESCRIPTION OF THE DRAWING

In order to illustrate the present invention further, reference is made to the accompanying drawings, in which.

DETAILED DESCRIPTION OF THE PREFERRED EMBODIMENTS

Figure 1:
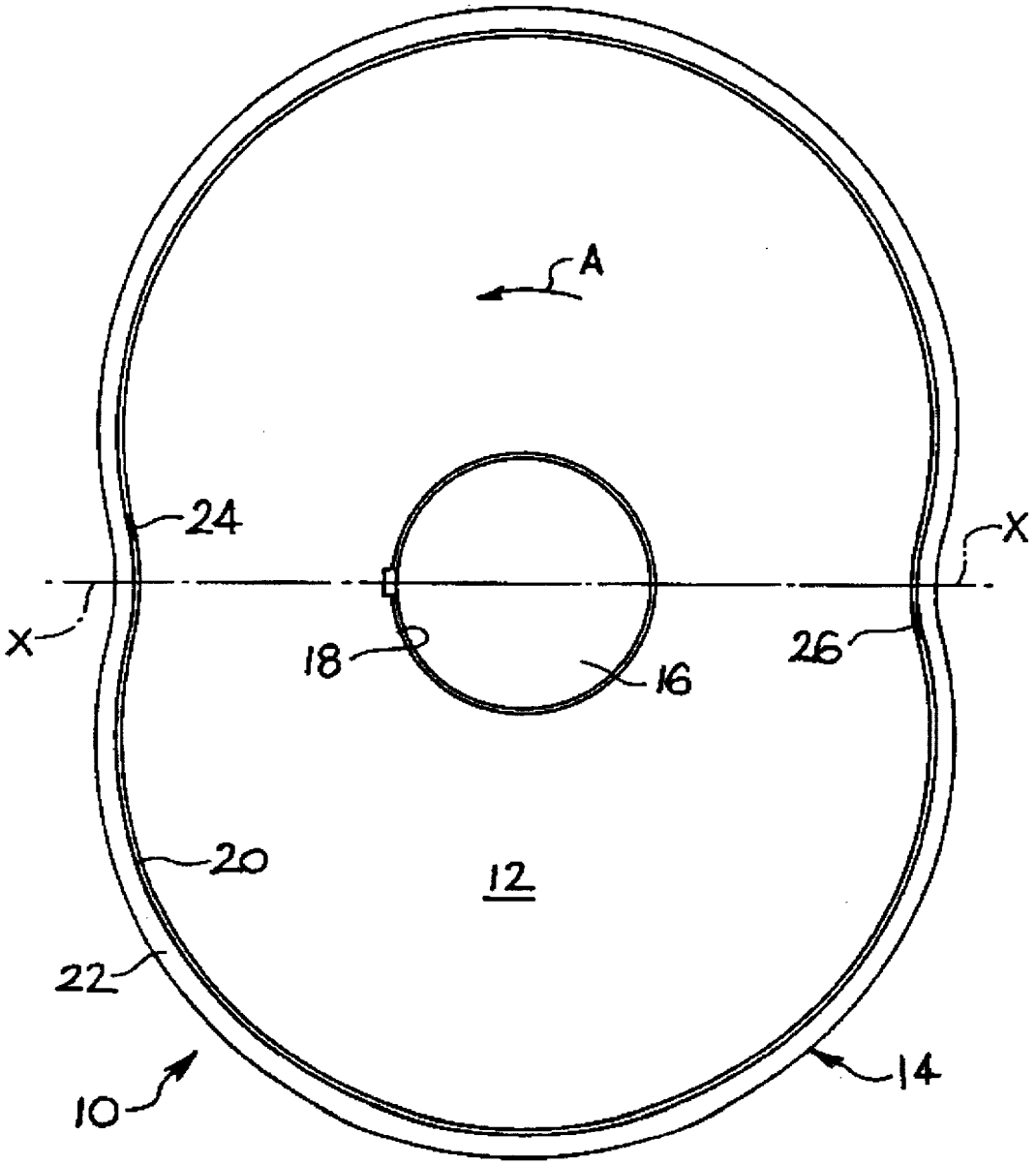
FIG. 1 shows a side face of a piston or rotor of a trochoidal piston rotary engine.

FIG. 1 illustrates a two-labed piston or rotor 10 suitable for a trochoidal rotary engine (not shown) having three working chambers. Rotor 10 has substantially parallel, planar side faces 12 of which only one is visible in FIG. 1. Around the edges of side faces 12, piston 10 defines an outer peripheral surface 14 having the shape of a trochoid or of a curve inside and parallel to a trochoid.

Piston 10 defines a central bore 16 in which a centre bearing 18 is mounted. Piston 10 is rotatable by means of bearing 18 on a crankpin of a crankshaft of its engine; rotation of piston 10 being anti-clockwise, as depicted by arrow A. If it is assumed that the crankshaft rotates clockwise.

Substantially parallel to and inwardly from peripheral surface 14, piston 10 has a groove 20 formed in side face 12. A similar groove is formed in the other side face. Each groove is closely adjacent to peripheral surface 14 to define a narrow cantilevered land 22. The respective grooves 20 accommodate respective side seals, as described with reference to FIGS. 2 to 10, in which corresponding parts are identified by the same reference numerals as used in FIG. 1. However, before proceeding to those Figures, it is to be noted that reference numerals 24,26 in FIG. 1 identifying the locations in grooves 20 of subsequently described tag slots.

Figure 2:
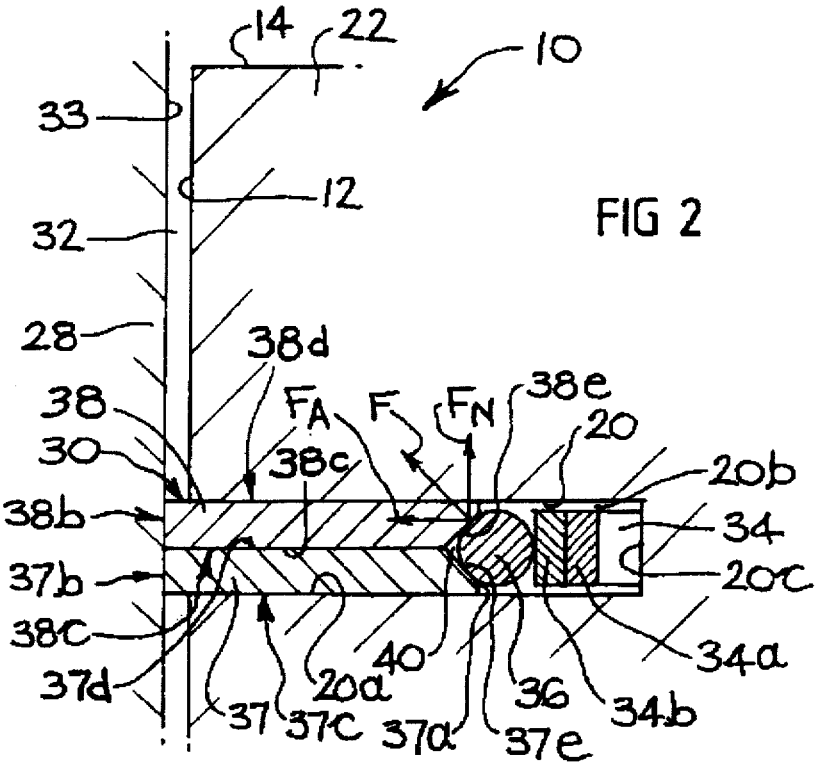
FIG. 2 is a part sectional view of a piston as in FIG. 1, with a part sectional view of its engine housing side plate, showing in section a first embodiment of a side seal according to the invention.

FIG. 2 is a partial sectional view of a piston 10, taken through its groove 20 at a location away from tag slots 24,26. In FIG. 2, side face 12 is shown relative to an adjacent side plate 28 of its engine housing. As shown, groove 20 is relatively narrow and has a depth inwardly of face 12 which substantially exceeds its width. Along the length of groove 20 around each lobe of piston 10, a respective side seal assembly 30 is provided in groove 20. The assemblies 30 are substantially to prevent leakage, beyond groove 20, of hot gases generated in the combustion chamber of an engine working chamber bounded by peripheral surface 14 of piston 10. There necessarily is a running clearance 32 between side face 12 of piston 10 and surface 33 of housing side plate 28, over substantially the full area of face 12, and the assemblies 30 are to provide a seal such that gas entering clearance 32 from beyond surface 14 is substantially prevented from passing beyond land 22.

Each end of one assembly 30 ends closely adjacent to a respective end of the other assembly 30. Thus, the seal provided by assemblies 30 is substantially continuous around piston 10. Obviously, for a piston with more than two lobes, there would be a corresponding number of assemblies 30 in a corresponding end-to-end relationship around its groove.

Groove 20 has substantially parallel inner and outer side faces 20*a* and 20*b* and a basal face 20*c*. Within groove 20, each assembly 30 has a spring system 34 which extends along groove 20, on basal face 20*c*, and a cam member 36 which extends around groove 20 against system 34. Each assembly 30 also has a seal member consisting of a pair of elongate members comprising an inner elongate member 37 adjacent face 20*a* and an outer elongate member 38 adjacent to face 20*b*.

The spring system 34 of each assembly 30 has, relative to the depth of groove 20, an inner spring member 34*a* bearing against basal face 20*c* of groove 20, and a similar outer spring member 34*b* bearing against member 34*a*. As formed, members 34*a*, 34*b* preferably have a curvature corresponding substantially to that of groove 20, although they can be bent to that curvature on being presented into groove 20. Also, as formed, members 34*a*, 34*b* are provided with a similar undulating set such that spring system 34 has a somewhat sinusoidal form around groove 20, with troughs bearing against basal face 20*c* of groove 20 and peaks spaced from face 20*c*. Members 34*a*, 34*b* are made of a suitable resilient metal such that the sinusoidal form enables system 34 to function as a spring.

Cam member 36 is in the form of a metal wire of circular section. Member 36 is formed with, or is bent to, a curvature substantially corresponding to that of groove 20. The diameter of member 36, and, also the width of system 34 laterally of its sinusoidal form, is slightly less than the width of groove 20 between its faces 20*a*, 20*b*, such that movement of member 36 and flexing of system 34 is not impeded by frictional engagement with faces 20*a*, 20*b*. Also, the curvature of member 36 to conform with that of groove 20 is such that member 36 has its longitudinal axis in a plane substantially parallel to basal face 20*c* of groove 20, so that member 36 contacts successive peaks of system 34 around groove 20.

Each of the elongate members 37,38 has the form of an elongate strip or ribbon and is bent to or is formed with a curvature corresponding substantially to that of groove 20. Also, each member 37,38 has a width, between a respective first edge 37*a*, 38*a* and a respective second edge 37*b*,38*b* thereof, which is substantially less than its thickness. As shown, member 37 has a width and thickness substantially equal to the width and thickness, respectively, of member 38. The arrangement is such that member 37 has a concave inner surface 37*c* and a convex outer surface 37*d*, and member 38 has corresponding surfaces 38*c*, 38*d*, with surfaces 37*d* and 38*c* opposed to each other. Separately, or in overlapping relationship, members 37,38 are received edge-wise into slot 20 such that the first edge of each is adjacent to cam member 36.

Member 37 is provided with a bevelled surface 37*e* at the junction of its first edge 37*a* and its convex outer surface 37*d*. Also, member 38 has a similar bevelled surface 38*e*, but at the junction of its first edge 38*a* and its concave inner surface 38*c*. The arrangement is such that surfaces 37*e*, 38*e* define a recess 40 of V-section within and around groove 20, with recess 40 opening towards and partially accommodating cam member 36. That arrangement and the width of members 37,38 is such that, with assembly 30 received in groove 20 and piston 10 mounted in its engine housing, spring system 34 provides a biasing force which acts to urge each seal member 37,38 into sealing engagement with surface 33 of side plate 28. That force is transmitted to each member 37,38 via cam member 36. However, as members 37,38 are contacted by member 36 at the respective bevelled surface 37*e*, 38*e*, the force also acts to force members 37,38 apart such that member 37 is urged into sealing engagement with side face 20*a* of groove 20, while member 38 is similarly urged into sealing engagement with side face 20*b*.

The spring force applied by spring system 34 on cam member 36 will be directed substantially at right angles to basal face 20*a* of groove 20. However, due to bevelled faces 37*e*, 38*e*, that spring force will be resolved at each bevelled surface 37*e*, 38*e* to provide divergent components; component F for seal member 38 and a similar, but oppositely inclined, component for member 37. The force component F will itself be resolved generate resultant components $F_A$ and $F_N$; with component $F_A$ acting to cause second member 38 to be urged so that its second edge 38*b* will sealingly engage surface 33 of side plate 28, and component $F_N$ acting to cause member 38 to be urged laterally of groove 20 so that its convex surface 38*d* will sealingly engage groove face 20*b*. The similar force component corresponding to F but acting on member 37 achieves a similar result, except that its component corresponding to $F_N$ will act oppositely to $F_N$ to cause member 37 to be urged so its concave surface 37*c* will sealingly engage face 20*a*.

The spring force applied by spring means 34 acts to force cam member 36 into recess 40, with member 36 sliding across bevelled faces 37*e*, 38*e*. Thus, as members 37,38 are moved apart, member 37 is able to continue to provide a cam action and maintenance of sealing engagement at surface 33 of plate 28 and at groove faces 20*a*, 20*b*.

The illustrated force components $F_A$ and $F_N$ are respectively directed parallel to and at right angles to side faces 20*a*, 20*b* of groove 20, with the implication of the same applying to the force component acting on seal member 37.

This of course indicates that bevelled surfaces 37*e*, 38*e* are inclined at 45° to the width direction of members 37,38. An angle of about 45° is suitable. However, it is to be understood that the angle can vary quite substantially, such as from about 30° to about 60°.

Figures 3, 3A, 4:
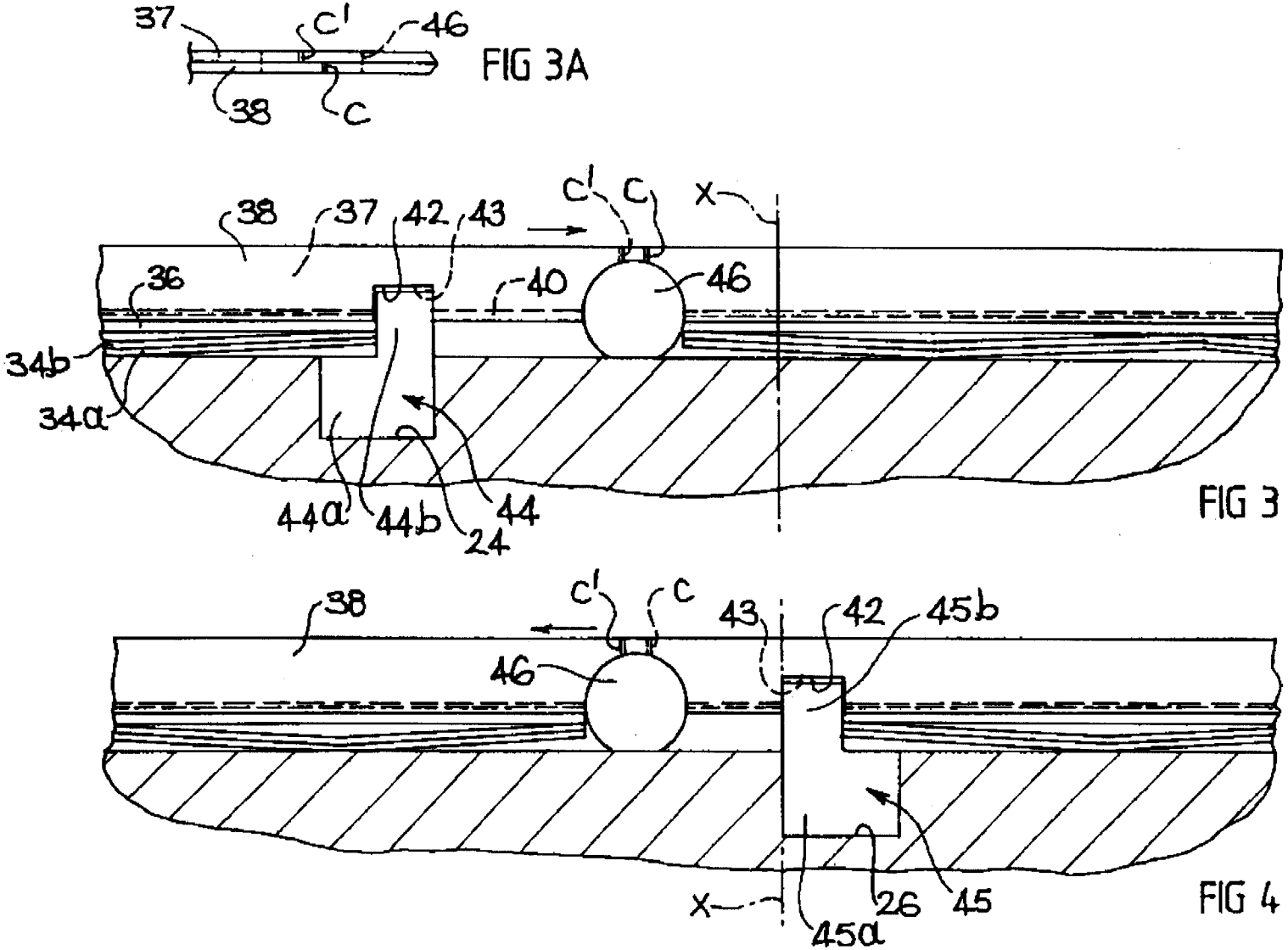
FIG. 3 is a sectional view taken along the outer side of the piston groove of FIG. 2, at a location corresponding to a position adjacent the left-hand extremity of the X—X axis of FIG. 1.
FIG. 3A is a view taken on line A—A of FIG. 3.
FIG. 4 corresponds to FIG. 3, but taken at a location corresponding to a position adjacent the right-hand extremity of axis X—X of FIG. 1.

The abovementioned groove slots 24,26 are respectively shown in FIGS. 3 and 4. FIG. 1 shows an axis X—X through opposed minimum points of waists between the lobes, in peripheral surface 14 of piston 10. Each slot 24,26 is slightly angularly offset from a respective end of axis X—X such that each slot 24,26 follows axis X—X in the direction of rotation of piston 10. Thus, each slot 24,26 is in a respective lobe, in a portion of groove 20 for its lobe which leads in that direction. Each slot 24,26 is defined in groove 20 but, as shown in FIGS. 3 and 4, has a depth in piston 10 which is greater than that of groove 20.

Opposed to each slot 24,26, each member 37 defines a respective recess 42 cut or formed in its first edge 37*a*, while each member 38 defines a respective recess 43 in its first edge 38*a*. For the members 37,38 of the assembly 30 of each lobe of piston 10, the recesses 42,43 are aligned, while recesses 42,43 are of lesser angular extent around groove 20 than the opposed one of slots 24,26.

In slot 24 there is an L-shaped bracket 44, while a similar bracket 45 is provided in slot 26. Each of brackets 44,45 has its base 44*a*, 45*a* received in the respective one of slots 24,26, with its stem 44*b*, 45*b* projecting above that slot into the opposed recesses 42,43. Each base 44*a*, 45*a* is firmly received in its one of slots 24,26, but stems 44*b*,45*b* are received in the recesses 42,43 with a slight clearance so as to accommodate longitudinal thermal expansion of members 37,38.

For the seal assembly 30 of each lobe of piston 10, the respective one of brackets 44,45 prevents longitudinal movement of members 37,38 in groove 20. Also, each assembly 30 has one end of its spring system 34 and of its cam member 36 abutting against the stem 44*b* or 45*b* of the respective one of brackets 44,45, so that longitudinal movement of system 34 and member 36 in groove 20 is prevented in one direction.

The members 37,38 of each assembly 30 have end portions by which they extend beyond the respective one of brackets 44,45 to a groove seal 46. Those end portions are not supported by the spring system 34 and cam member 36 of their assembly 30, but are adequately supported due to the relatively short spacing between each bracket 44,45 and the respective groove seal 46.

Each groove seal 46 is flexible and may for example be made of a heat resistant silicon rubber. Groove seals 46, in the form shown, are cylindrical and are held in groove 20 by a firm friction fit, with the axis of each extending laterally of groove 20. Each groove seal can be placed on the waist of piston 10 represented by axis X—X or, as shown, closely adjacent axis X—X. The groove seal 46 adjacent bracket 44 is intermediate that bracket and axis X—X, while the other groove seal 46 leads the axis X—X in the direction of rotation, such that the axis is between that other groove seal 46 and bracket 45.

Adjacent each end of axis X—X, respective ends of members 37,38 of one assembly 30 are opposed to adjacent ends of the members 37,38 of the other assembly 30. The opposed ends overlie a respective groove seal 46 and members 37,38 are cut out over a major part of their thickness form their first edges 37*a*, 38*a*, so as to conform closely to the curvature of that groove seal 46. The opposed ends are slightly spaced, to allow for longitudinal thermal expansion of members 37,38. However, the slight clearance C between members 37 and the slight clearance C' between members 36, while kept to a minimum, can allow some small leakage of hot gases across groove 20 and, to restrict this leakage, the clearances C,C' are angularly offset by the end of the seal member 37 of one assembly 30 overlapping with the seal member 38 of the other assembly 30.

It is indicated above that one end of the spring system 34 and the cam member 36 of each assembly 30 abuts against a respective one or brackets 44,45. As shown in FIGS. 3 and 4, the other end abuts against a respective one of groove seal 46. Thus each system 34 and member 36 is prevented from moving in groove 20 in either longitudinal direction.

Figure 5:
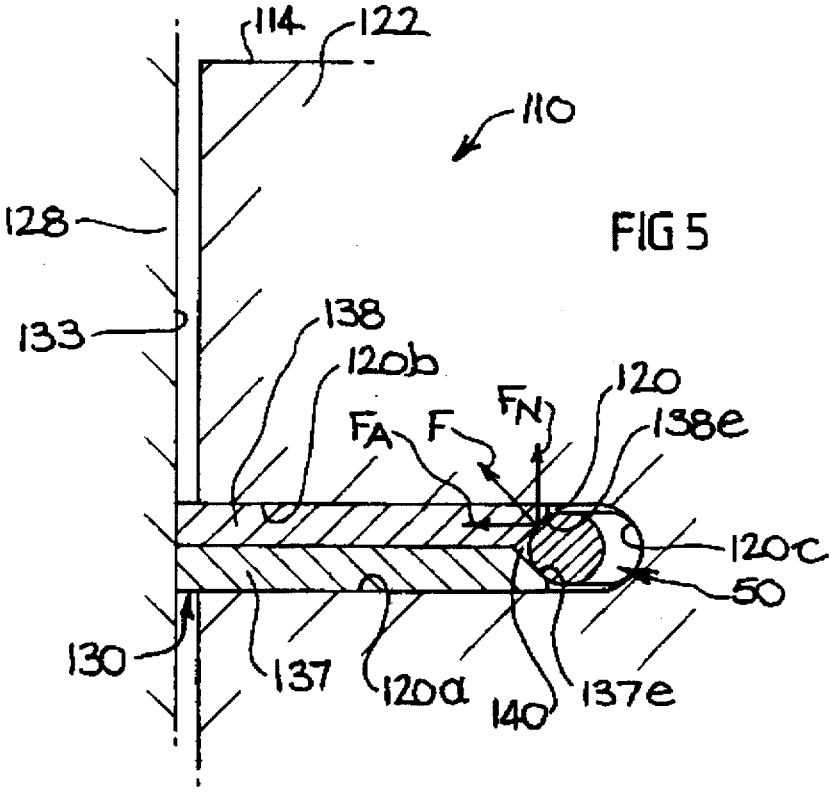
FIG. 5 corresponds to FIG. 2, but shows a side seal according to a second embodiment.
Figure 6:
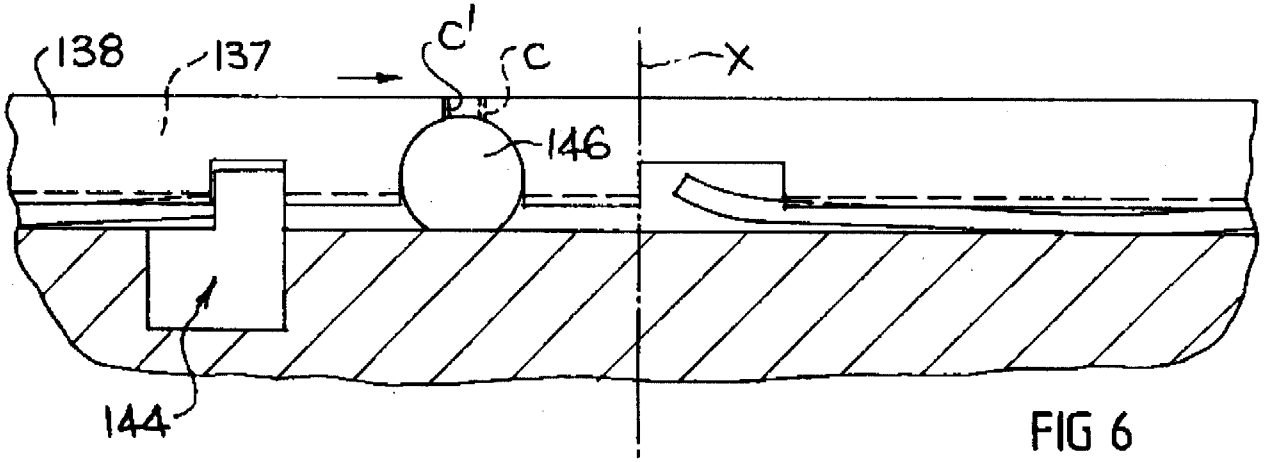
FIG. 6 and 7 correspond to FIGS. 3 and 4, but relate to the side seal embodiment of FIG. 4.
Figure 7:
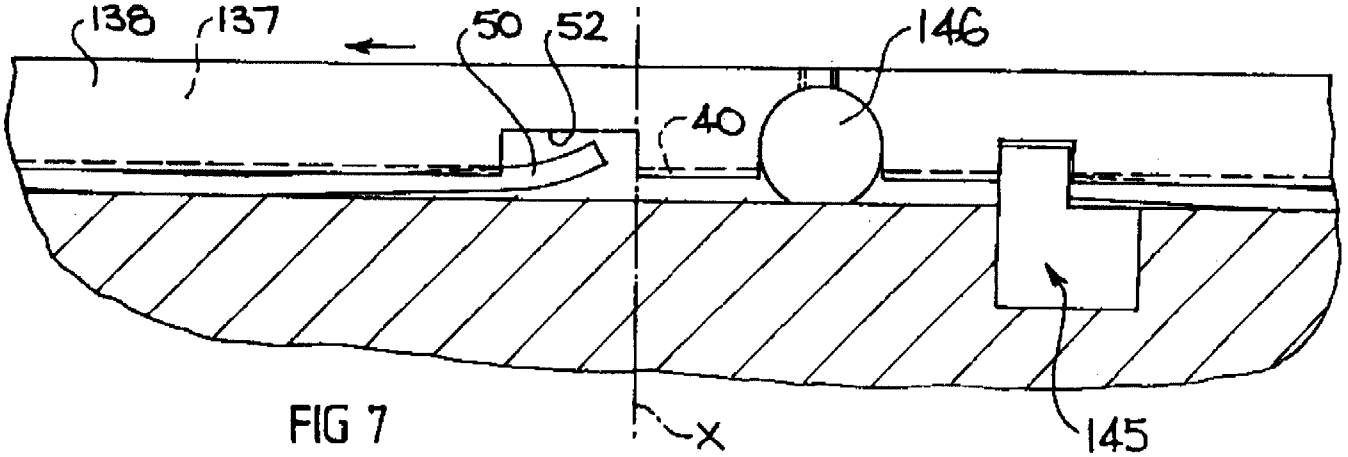

FIGS. 5 to 7 show a second embodiment of side seal according to the invention. Parts corresponding to those of the first embodiment are identified by the same reference numeral, plus 100. However, the overall arrangement of the embodiment of FIGS. 5 to 7 will be understood from the preceding description of the first embodiment. The following description therefore is limited to matters of difference.

In seal assembly 130 of FIGS. 5 to 7, elongate members 137,138 are essentially the same as members 37,38 of the first embodiment. However, spring system 34 and cam member 38 of the first embodiment have been replaced by a cam spring 50.

Like cam member 38, spring 50 is of round section wire and extends longitudinally in groove 120. However, like spring system 34, spring 50 is of undulating, somewhat sinusoidal form and made of resilient metal. Thus, troughs of spring 50 contact face 120*c* of groove 120, while its peaks are accommodated in recess 140 defined by bevel surfaces 137*e*, 138*e* of seal members 137,138. Also, face 120*c* of groove 120 is arcuate in cross-section, to accommodate the round section of spring 50.

The combined effect of system 34 and cam member 36 of the first embodiment is achieved by spring 50. Thus spring 50 acts to urge members 137,138 into sealing engagement with surface 133 of side plate 128, while it also forces members 137,138 apart and into respective sealing engagement with side faces 120*a*, 120*b* of groove 120. Of course, member 36 of the first embodiment provides contact along the full extent of bevelled surfaces 37*e*,38*e*. In contrast, spring 50 provides contact with surfaces 137*e*, 138*e* only at its peaks, although this does not detract from performance of spring 50.

One end of the spring 50 of each seal assembly 130 contacts a respective one of brackets 144,145. The other end of spring 50 is located by a recess 52 provided in each seal member 137,138 and similar to recesses 40.

Figure 8:
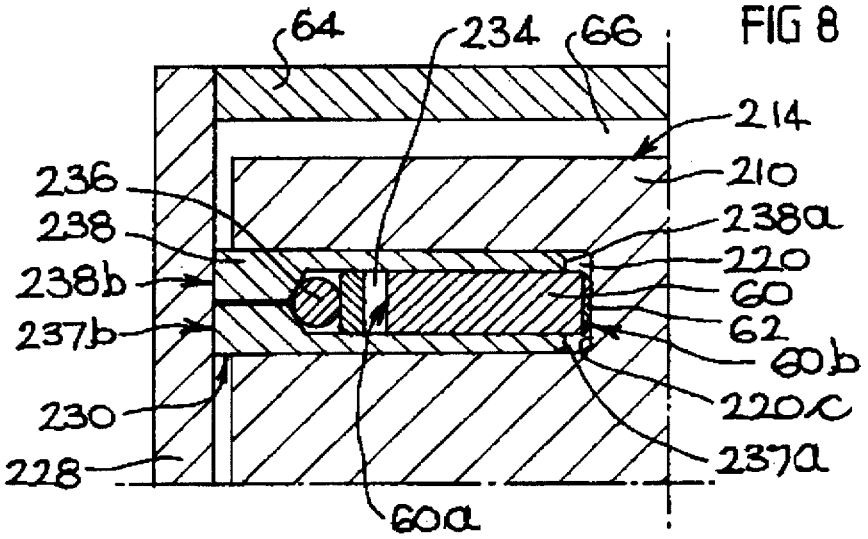
FIGS. 8 to 10 correspond to FIG. 2, but each shows a respective further side seal embodiment.
Figure 9:
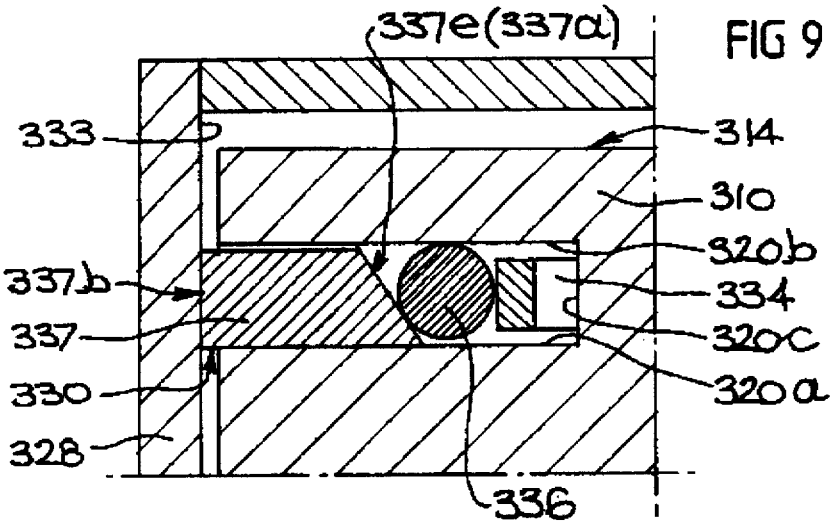

The arrangement of each of FIGS. 8 to 9 also will be understood from the description of the first embodiment. The matters of difference therefore will be emphasised, with corresponding parts identified by the same reference numeral, respectively plus 200,300 and 400.

In FIG. 8, seal 230 differs in that each member 237,238 is stepped between their first edges 237*a*,238*a* and their second edges 237*b*, 238*b* so as to have respective width portions of different thickness. The respective bevelled surfaces are defined by a shoulder between those portions. Spring system 234 and cam member 236 are similar to system 34 and member 36 of the first embodiment, except that system 234 consists of a single undulating spring member rather than two such members.

Additionally, system 234 is spaced from face 220*c* of groove 220 by an elongate arcuate backing strip 60. As shown, strip 60 is a close, sliding fit in the space defined between seal members 237, 238, over the thinner portions of members 237, 238 inwardly from their first edges 237*a*, 238*a*. An edge 60*a* of strip 60, between members 237, 238, provides an abutment surface for spring system 234. An edge 60*b* of strip 60 is opposed to face 220*c* of groove 220, with a layer 62 of sealing material, such as of silicon rubber, being provided between edge 60*b* and face 220*c*. Layer 62 can be omitted, if required, although it can assist in overall sealing efficiency.

Strip 60 can assist in preventing twisting of, and provides enhanced stability for, seal members 237, 238. However, its principal purpose is to provide an abutment or reaction surface against which spring system 234 reacts, necessitated by the location of system 234 between members 237, 238, away from surface 220*c*.

In FIG. 8, there also is shown a peripheral part 64 of the engine housing which couples plate 226 to a second such plate on the other side of piston 210. Part of a working chamber 66 of the engine is defined between inner surface 64*a* of part 64 and peripheral surface 214 of piston 210.

In FIG. 9, side seal 330 differs significantly from seal 30 of the first embodiment. Seal member 37 is formed from a single elongate member, it is identified by the corresponding reference 337. However, despite the significant difference, operation will readily be understood from preceding description.

Spring system 334 and cam member 336 respectively correspond in form to system 234 and member 236 of the embodiment of FIG. 8. However, cam member 336 is of a larger diameter which is only slightly less than the spacing between walls 320*a*, 320*b* of groove 320. The arrangement is such that spring system 334 biases seal member 337 to bring its second edge 337*b* into sealing engagement with surface 333 of plate 328. Again, the bias is applied through cam member 336 to bevelled surface 337*e*, generating a force component urging surface 337*c* into sealing engagement with face 320*a* of groove 320. However, with resultant sliding across bevelled surface 337*e*, cam member 336 is moved into sealing engagement with face 320*b* of groove. Thus, given that member 336 also will be in sealing engagement with bevelled surface 337*e*, effective gas-tight sealing is achieved at each of faces 320*a*, 320*b* of groove 320, as in the preceding embodiments.

Figure 10:
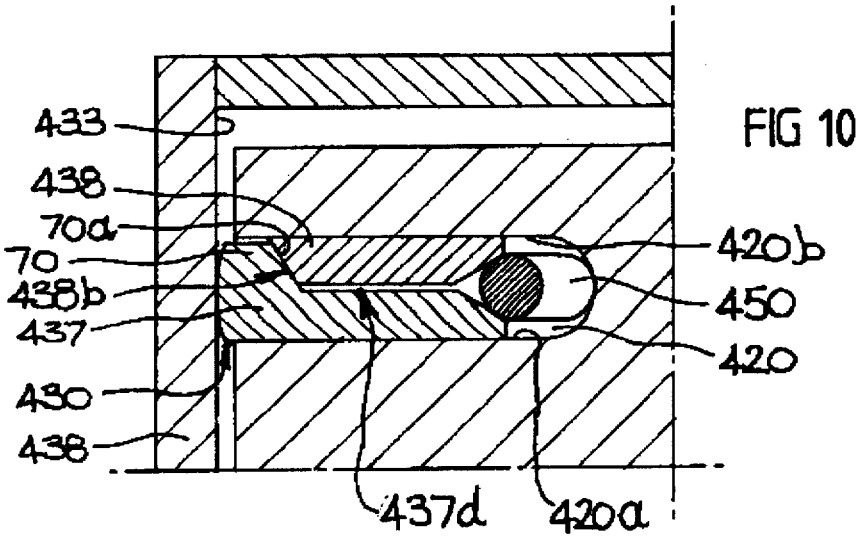

The side seal 430 shown in FIG. 10 is a further departure from the preceding embodiments. However, in this embodiment there is only a single elongate member 437 which provides engagement with surface 433 of side plate 428, despite there being a second elongate member 438. Also, members 437, 438 provide for respective sealing engagement with faces 420*a*, 420*b* of groove 420, essentially in the manner as detailed for the embodiment of FIGS. 5 to 7.

The principal differences in seal 430 arises from member 437 being of increased thickness adjacent second edge 437*b*, to define a longitudinal rib 70 around its convex surface 437*c*, and member 438 being of lesser width than member 437 and having its second edge 438*b* in abutting relationship with rib 70. Also, member 438 has its edge 438*b* bevelled, oppositely with respect to its bevelled surface 438*e*, while bevelled edge 438*b* is complementary to a bevelled side face 70*a* of rib 70. The arrangement is such that further force components are generated between faces 438*b* and 70*a*, acting to urge member 438 into sealing engagement with face 420*b* of groove 420, and to assist urging member 437 both into its sealing engagement with surface 433 of plate 428 and face 420*a* of groove 420.

Each embodiment provides for effective sealing at a side plate surface. However, of comparable importance, they provide effective sealing against each side face of the piston groove in which they are mounted. Such sealing is provided at all times, with this being particularly important during compression and combustion cycles of high gas pressure.

In side seals 30 and 130 of the first and second embodiments, the respective grid joiners 46 and 146 can be eliminated, if the angular separation between clearances C, C' is increased sufficiently. Of course the cut-outs to accommodate joiners 46 and 146 then would not be provided. A degree of separation of pressurization groove 20, 120, between the respective lobes is provided by joiners 46, 146, but brackets 44, 45; 144, 145 could be adapted to provide this if joiners 46, 146 are not provided. Also, elimination of joiners 46 enables members 37, 38 to be supported fully by extension of spring system 34 and cam member 38; while the same could be provided by extension of system 134 and member 138 for members 137, 138 on elimination of joiners 146.

In the side seals 30 and 130 of the first two embodiments, members 37, 38; 137, 138 can be made of thin section, flexible material. They thus can be received into the respective grooves 20, 120 without prior forming. However, the thickness and/or profile of members 237, 238 of FIG. 8, member 337 of FIG. 9 and at least member 437 of FIG. 10 is likely to necessitate preforming to the curvature of the respective piston groove.

It is to be appreciated that the spring system and cam member, or combined cam spring, of specific embodiments can be adapted for use in other embodiments. Thus, cam spring 50 of FIGS. 5 to 7 could, if required, be used in the embodiment of FIGS. 2 to 4 in place of system 34 and member 36.

It also is to be appreciated that it is not necessary that member 36 of the first embodiment, member 236 of the third embodiment, or member 336 of the fourth embodiment be of round section. Each could, for example be of at least part polygonal section, to present a respective flat face to abut each respective bevel edge. Similar considerations apply to the cam spring 50 of the second embodiment, and the similar cam spring of the fifth embodiment.

Figure 11:
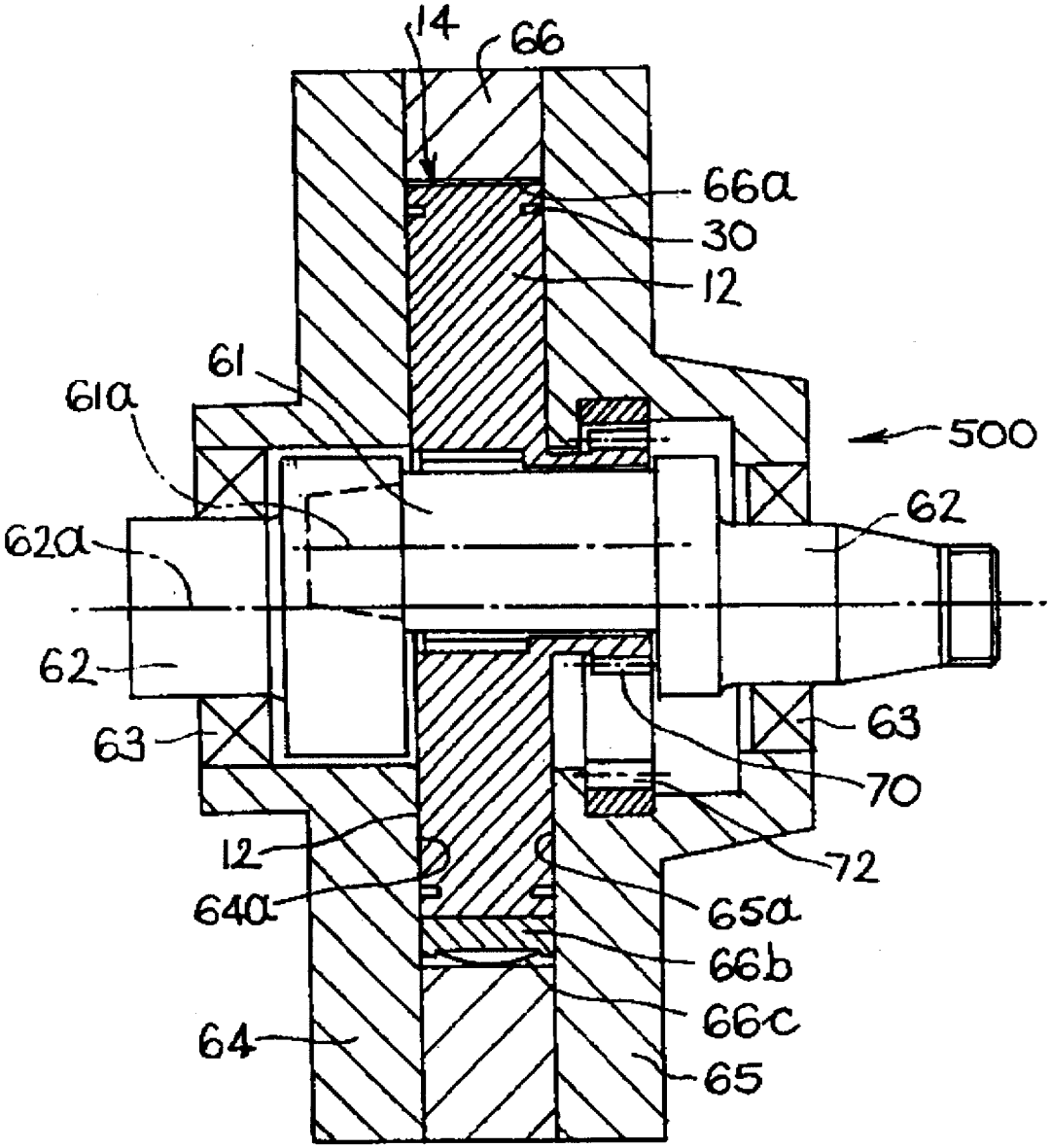
FIG. 11 is an axial cross-sectional view of a trochoidal piston rotary engine with the piston at top dead centre position but excluding porting and ducting arrangements.
Figure 12:
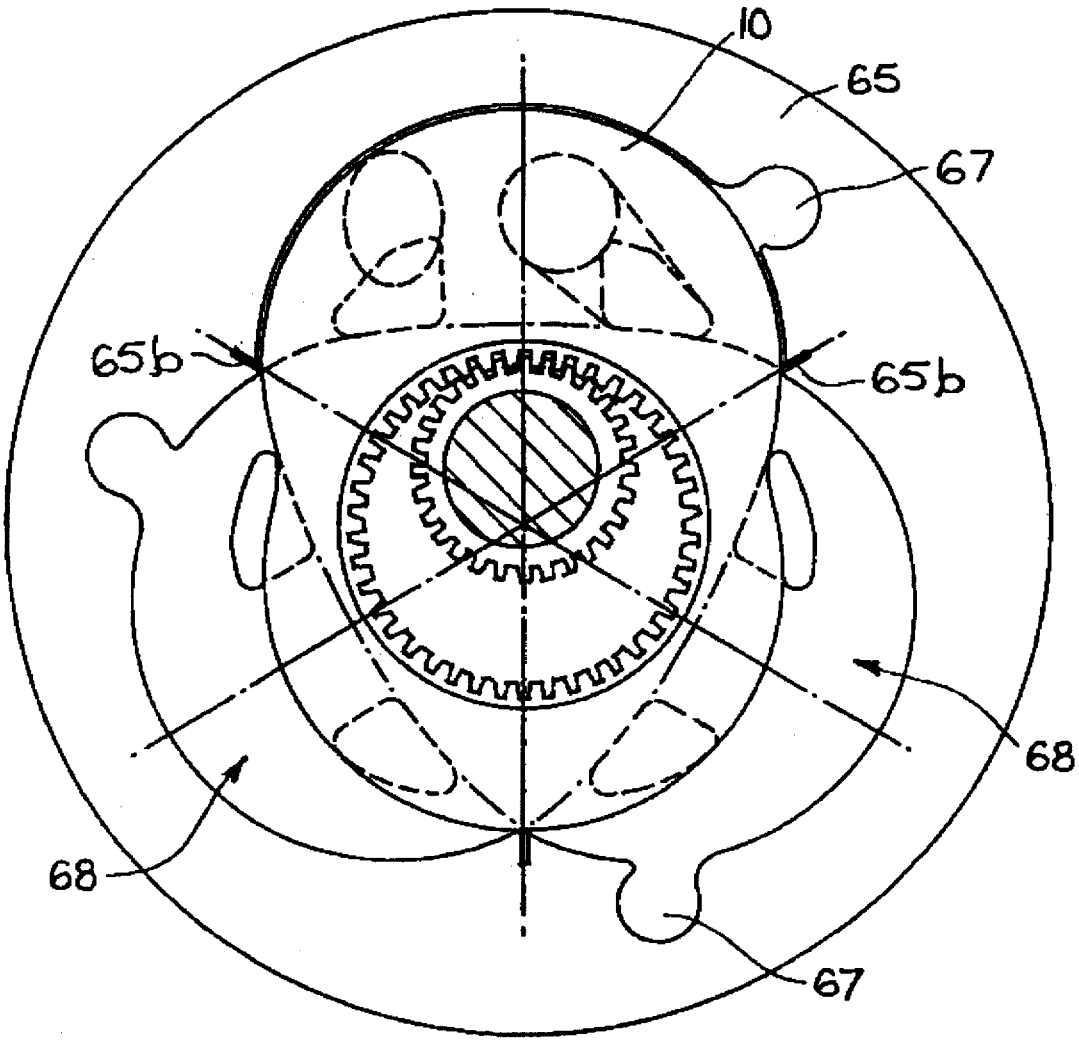
FIG. 12 is a transverse sectional end view from the rear of engine on line 1—1 of FIG. 11, illustrating the relative positions of the inlet and exhaust ports and ducts.

In FIGS. 11 and 12 engine 500 consists of a piston member 10 which is rotatably mounted on a crankpin 61 of crankshaft 62, and which has an outer peripheral surface 14 in the shape of a curve inside and parallel to a two lobed epitrochoid. Crankpin 61 has its axis 61*a* parallel to, but offset from, main axis 62*a* of crankshaft 62, and crankshaft 62 is rotatably mounted in bearings 63 of side-plates 64 and 65 fixed to either side of the housing body portion 66.

Body portion 66 has an inside peripheral surface 66*a* which, allowing for a running clearance therearound, generally has a shape inside and parallel to the outer enclosing curve or outer envelope of the epitrochoid on which surface 66 is based. Surface 66*a* departs from the shape and region of combustion chambers 56. Three displacement volumes or working chambers 58 are formed between the surface 66*a*, surface 14 of piston member 10 and the inside surfaces 64*a*, 65*a* of side plates 64, and 65. A respective partially cylindrical combustion chamber 67 is formed in the housing body portion 64 between inner surfaces 64*a*, 65*a* of side plates 64, 65, in each of the three working chambers 68.

The shape of combustion chamber 67 can take many forms within the housing body portion 66, to improve the scavenging efficiency.

Correct phasing of piston member 10 during its opposite rotation with respect to crankshaft 62 is provided by external gear 70, which is fixed to piston member 10, and an internal gear 72 fixed to side plate 65 with which external gear 70 meshes. The ratio of internal gear 72 to external gear 70 is preferably 3:2 for the two lobe piston member 10.

Sealing between successive working chambers 68 is provided by respective seals 65 provided in housing body portion 66. Seals 66 are known in the art and, as shown in FIG. 11, each seal 66 is biased towards piston 10 by a spring 66.

Also, piston member 10 is provided at each side face 12 thereof with a respective peripheral piston side seal 30 to provide a seal between each chamber 68 and the running clearance between piston 10 and each side plate 64 and 65.

In each embodiment, it can be highly desirable for compression and combustion gases to enter the piston groove behind the respective side seals. As each embodiment is designed to seal against each side face of the piston groove, it therefore may be desirable to incorporate into the piston a suitable entrance hole or slot communicating with the piston groove at a location for each lobe which is intermediate the ends of axis X—X. Such hole or slot 80 illustrated schematically in FIG. 1 for each lobe of piston 10.

Finally, it is to be understood that various alterations, modifications and/or additions may be introduced into the constructions and arrangements of parts previously described without departing from the spirit or ambit of the invention.

We claim:

1. A piston side seal system for a multi-lobed piston of a trochoidal rotary engine having a housing in which the piston is rotatable and which defines with a peripheral edge of the piston a plurality of working chambers each having a combustion chamber; the piston side seal system comprising an elongate, resilient metal seal means, biasing means and cam means by which the biasing means is co-operable with the seal means; wherein the biasing means is adapted for lateral location in a peripheral side seal groove which is formed in a side face of the piston and which is located adjacent, and substantially parallel, to the peripheral edge of the piston; the biasing means comprises an elongate, undulating spring; the cam means is adapted for lateral location in the peripheral side seal groove after said location of the biasing means and comprises an elongate metal member; the seal means is in the form of an elongate ribbon, having first and second opposite side edges, and is adapted for lateral location in the peripheral side seal groove of the piston after said location of the cam means whereby, in use, the first edge of the seal means is within said groove and the second edge of the seal means faces and provides a seal with a side plate surface of a side plate of the engine housing under the action of a force applied by the biasing means to the cam means to urge said seal means outwardly with respect to the groove; the seal means is formed of two elongate seal members each in the form of an elongate ribbon and each having first and second side edges, the first edge of each seal member forms a respective part of the first edge of the seal means and the second edge of the seal means is defined by the second edge of at least one of the two seal members; each seal member defines a respective, longitudinally extending bevelled surface with the bevelled surfaces mutually inclined to provide a V-shaped formation in which the cam means is received and wherein the seal means is engaged by the cam means at each bevelled surface whereby, when the force is applied to each bevelled surface, by the cam means under the action of the biasing means the force is resolved in each seal member into a first component which acts to achieve the sealing of the second edge of the seal means with the side plate surface of the engine housing and a second component which acts to urge each seal member into engagement with a respective side of the piston groove to provide a gas seal between each seal member and that respective side of the groove, and wherein one seal member is of a narrower width between its first and second edges than the other seal member, the second edge of the one seal member is provided with a further bevelled surface and the other seal member is stepped adjacent to its second edge to define a further bevelled surface which faces the further bevelled surface of the one seal member whereby the first force component resolved in each seal member causes the respective further bevelled surfaces to abut in acting to achieve sealing of the second edge of the seal means with the side plate surface.

2. A piston side seal system for a multi-lobed piston of a trochoidal rotary engine having a housing in which the piston is rotatable and which defines with a peripheral edge of the piston a plurality of working chambers each having a combustion chamber; the piston side seal system comprising an elongate, resilient metal seal means and biasing means co-operable with the seal means; wherein the biasing means is adapted for lateral location in a peripheral side seal groove which is formed in a side face of the piston and which is located adjacent, and substantially parallel, to the peripheral edge of the piston; the biasing means comprises an elongate, undulating spring; the seal means is in the form of an elongate ribbon, having first and second opposite side edges, and is adapted for lateral location in the peripheral side seal groove of the piston after said location of the biasing means whereby, in use, the first edge of the seal means is within said groove and the second edge of the seal means faces and provides a seal with a side plate surface of a side plate of the engine housing under the action of a force applied by the biasing means to urge said seal means outwardly with respect to the groove; the seal means is formed of two elongate seal members each in the form of an elongate ribbon and each having first and second side edges, the first edge of each seal member forms a respective part of the first edge of the seal means and the second edge of the seal means is defined by the second edge of at least one of the two seal members; each seal member defines a respective longitudinally extending bevelled surface with the bevelled surfaces mutually inclined to provide a V-shaped formation in which the biasing means is received; wherein the seal means is engaged by the biasing means at each bevelled surface whereby, when the force is applied at each bevelled surface, the force is resolved in each seal member into a first component which acts to achieve the sealing of the second edge of the seal means with the side plate surface of the engine housing and a second component which acts to urge each seal member into engagement with a respective side of the piston groove to provide a gas seal between each seal member and that respective side of the groove; and wherein each of the elongate member is stepped intermediate of its first and second edges and said step defines a respective one of said bevelled surfaces.

3. A piston side seal system for a multi-lobed piston of a trochoidal rotary engine having a housing in which the piston is rotatable and which defines with a peripheral edge of the piston a plurality of working chambers each having a combustion chamber; the piston side seal system comprising an elongate, resilient metal seal means and biasing means co-operable with the seal means; wherein the biasing means is adapted for lateral location in a peripheral side seal groove which is formed in a side face of the piston and which is located adjacent, and substantially parallel, to the peripheral edge of the piston; the biasing means comprises an elongate, undulating spring; the seal means is in the form of an elongate ribbon, having first and second opposite side edges, and is adapted for lateral location in the peripheral side seal groove of the piston after said location of the biasing means whereby, in use, the first edge of the seal means is within said groove and the second edge of the seal means faces and provides a seal with a side plate surface of a side plate of the engine housing under the action of a force applied by the biasing means to urge said seal means outwardly with respect to the groove; the seal means is formed of two elongate seal members each in the form of an elongate ribbon and each having first and second side edges, the first edge of each seal member forms a respective part of the first edge of the seal means and the second edge of the seal means is defined by the second edge of at least one of the two seal members; each seal member defines a respective longitudinally extending bevelled surface with the bevelled surfaces mutually inclined to provide a V-shaped formation in which the biasing means is received; wherein the seal means is engaged by the biasing means at each bevelled surface whereby, when the force is applied at each bevelled surface, the force is resolved in each seal member into a first component which acts to achieve the sealing of the second edge of the seal means with the side plate surface of the engine housing and a second component which acts to urge each seal member into engagement with a respective side of the piston groove to provide a gas seal between each seal member and that respective side of the groove; and wherein the second edge of the seal means is defined by the second edge of only one of said elongate seal members whereby the second edge of said one seal member is adapted to face and provide a seal with said side plate surface of the engine housing.

4. A piston and side seal assembly for a trochoidal rotary engine, the assembly including:

(a) a multi-lobed piston mountable for rotation in an engine housing which defines with a peripheral edge of the piston a plurality of working chambers each having a combustion chamber, the piston defining in each of opposite side faces thereof a respective peripheral side seal groove which is located adjacent, and substantially parallel to the peripheral edge whereby a respective portion of each groove extends around each lobe of the piston; and (b) a respective piston side seal system for each portion of each groove, each side seal system comprising an elongate, resilient metal seal means and biasing means co-operable with the seal means;

wherein, for the respective side seal system for each portion of each side seal groove:

(i) the biasing means is adapted for lateral location in the side seal groove portion and comprises an elongate, undulating spring;

(ii) the seal means is in the form of an elongate ribbon, having first and second opposite side edges, and is adapted for lateral location in the peripheral side seal groove portion after said location of the biasing means whereby, in use, the first edge of the seal means is within said groove portion and the second edge of the seal means faces and provides a seal with a side plate surface of a side plate of the engine housing under the action of a force applied by the biasing means to urge said seal means outwardly with respect to the groove portion;

(iii) the seal means is formed of two elongate seal members each in the form of an elongate ribbon and each having first and second side edges, the first edge of each seal member forms a respective part of the first edge of the seal means and the second edge of the seal means is defined by the second edge of at least one of the two seal members;

(iv) each seal member defines a respective, longitudinally extending bevelled surface with the bevelled surfaces mutually inclined to provide a V-shaped formation in which the biasing means is received; and (v) the seal means is engaged by the biasing means at each bevelled surface whereby when the force is applied to each bevelled surface, the force is resolved in each seal member into a first component which acts to achieve the sealing of the second edge of the seal means with the side plate surface of the engine housing and a second component which acts to urge each seal member into engagement with a respective side of the piston groove portion to provide a gas seal between each seal member and that respective side of the groove portion.

5. A trochoidal rotary engine including a piston and side seal assembly as defined in claim 4, and further including a respective inter-lobe groove seal adjacent ends of successive piston side seal systems, each of which groove seal substantially prevents gas pressure in one groove portion from being transmitted to another adjacent groove portion; wherein each groove seal includes a bracket locatable in a cut-out formed in one end of the seal means of one of the adjacent side seal systems and in a recess defined by a short length of the piston groove adjacent to a waist of the piston, with the groove at said recess having an increased depth; the bracket of each groove seal providing a sealing fit between each side of the groove and further providing sealing contact with a bottom surface of the groove and the cut-out in the seal means.

6. A trochoidal rotary engine including a piston and side seal assembly as defined in claim 4, and, further including a respective inter-lobe seal adjacent ends of successive piston side seal systems, each of which substantially prevents gas pressure in one groove portion from being transmitted to another adjacent groove portion; wherein each groove seal includes a resilient joiner member which fits firmly in the piston groove and which inter-fits with a cut-out at or adjacent to one end of the seal means of one of adjacent side seal systems, adjacent to a waist of the piston; the resilient joiner member of each groove seal providing a sealing fit between each side of the groove and further providing a sealing fit between a bottom surface of the groove and underside of the seal means.

7. A piston and side seal assembly for a trochoidal rotary engine, the assembly including:

(a) a multi-lobed piston mountable for rotation in an engine housing which defines with a peripheral edge of the piston a plurality of working chambers each having a combustion chamber, the piston defining in each of opposite side faces thereof a respective peripheral side seal groove which is located adjacent, and substantially parallel to the peripheral edge whereby a respective portion of each groove extends around each lobe of the piston; and (b) a respective piston side seal system for each portion of each groove, each side seal system comprising an elongate, resilient metal seal means, biasing means, and cam means by which the biasing means is co-operable with the seal means;

wherein for the respective seal system for each portion of each side seal groove:

(i) the biasing means is adapted for lateral location in a peripheral side seal groove portion and comprises an elongate, undulating spring;

(ii) the cam means is adapted for lateral location in the peripheral side seal groove portion after said location of the biasing means and comprises an elongate, metal member;

(iii) the seal means is in the form of an elongate ribbon, having first and second opposite side edges, and is adapted for lateral location in the peripheral side seal groove portion after said location of the cam means whereby, in use, the first edge of the seal means is within said groove portion and the second edge of the seal means faces and provides a seal with a side plate surface of a side plate engine housing under the action of a force applied by the biasing means to the cam means to urge said seal means outwardly with respect to the groove portion;

(iv) the seal means is formed of two elongate seal members each in the form of an elongate ribbon and each having first and second side edges, the first edge of each seal member forms a respective part of the first edge of the seal means and the second edge of the seal means is defined by the second edge of at least one of the two seal members;

(v) each seal member defines a respective, longitudinally extending bevelled surface with the bevelled surfaces mutually inclined to provide a V-shaped formation in which the cam means is received; and (vi) the seal means is engaged by the cam means at each bevelled surface whereby, when the force is applied to each bevelled surface by the cam means under the action of the biasing means, the force is resolved in each seal member into a first component which acts to achieve the sealing of the second edge of the seal means with the side plate surface of the engine housing and a second component which acts to urge each seal member into engagement with a respective side of the piston groove portion to provide a gas seal between each seal member and that respective side of the groove portion.

8. A seal member according to claim 7 wherein the relative movement between the cam member and bevelled surface achieves the sealing of the second edge of said seal member with the side plate surface and also engages the seal member with one side of the piston groove and further characterised in that the spring member urges the cam member to engage with the other side of the groove.

9. A trochoidal rotary engine including a piston and side seal assembly as defined in claim 9, and further including a respective inter-lobe groove seal adjacent ends of successive piston side seal systems, each of which substantially prevents gas pressure in one groove portion from being transmitted to another adjacent groove portion from being transmitted to another adjacent groove portion; wherein each groove seal includes a bracket locatable in a cut-out formed in one end of the seal means of one of the adjacent side seal systems and in a recess defined by a short length of the piston groove adjacent to a waist of the piston, with the groove at said recess having an increased depth; the bracket of each groove seal providing a sealing fit between each side of the groove and further providing sealing contact with a bottom surface of the groove and the cut-out in the seal means.

10. A trochoidal rotary engine including a piston and side seal assembly as defined in claim 8, and further including a respective inter-lobe groove seal adjacent ends of successive piston side seal systems, each of which substantially prevents gas pressure in one groove portion from being transmitted to another adjacent groove portion; wherein each groove seal includes a bracket locatable in a cut-out formed in one end of the seal means of one of the adjacent side seal systems and in a recess defined by a short length of the piston groove adjacent to a waist of the piston, with the groove at said recess having an increased depth; the bracket of each groove seal providing a sealing fit between each side of the groove and further providing sealing contact with a bottom surface of the groove and the cut-out in the seal means.

11. A trochoidal rotary engine including a piston and side seal assembly as defined in claim 7, and further including a respective inter-lobe seal joiner, between adjacent ends of successive piston side seal systems, each of which substantially prevents gas pressure in one groove portion from being transmitted to another adjacent groove portion; wherein each seal joiner includes a resilient joiner member which fits firmly in the piston groove and which interfits with a cut-out at or adjacent to one end of the seal means of one of adjacent side seal systems, adjacent to a waist of the piston; the resilient joiner member of each seal joiner providing a sealing fit between each side of the groove.

12. A piston side seal system for a multi-lobed piston of a trochoidal rotary engine having a housing in which the piston is rotatable and which defines with a peripheral edge of the piston a plurality of working chambers each having a combustion chamber; the piston side seal system comprising an elongate, resilient metal seal means, biasing means and cam means by which the biasing means is co-operable with the seal means; wherein the biasing means is adapted for lateral location in a peripheral side seal groove which is formed in a side face of the piston and which is located adjacent, and substantially parallel, to the peripheral edge of the piston; the biasing means comprises an elongate, undulating spring; the cam means is adapted for lateral location on the peripheral side seal groove after said location of the biasing means and comprises an elongate, metal member; the seal means is in the form of an elongate ribbon, having first and second opposite edges, and is adapted for lateral location in the peripheral side seal groove of the piston after said location of the cam means whereby, in use, the first edge of the seal means is within said groove and the second edge of the seal means faces and provides a seal with a side plate surface of a side plate of the engine housing under the action of a force applied by the biasing means to the cam means to urge said seal means outwardly with respect to the groove; the seal means is formed of two elongate seal members each in the form of an elongate ribbon and each having first and second side edges, the first edge of each seal member forms a respective part of the first edge of the seal means; each seal member defines a respective, longitudinally extending bevelled surface with the bevelled surfaces mutually inclined to provide a V-shaped formation in which the cam means is received; wherein the seal means is engaged by the cam means at each bevelled surface whereby, when the force is applied at each bevelled surface by the cam means under the action of the biasing means, the force is resolved in each seal member into a first component which acts to achieve the sealing of the second edge of the seal means with the side plate surface of the engine housing and a second component which acts to urge each seal member into engagement with a respective side of the piston groove to provide a gas seal between each seal member and that respective side of the groove; and wherein each of the elongate members is stepped intermediate of its first and second edges and said step defines a respective one of said bevelled surfaces.

13. A piston side seal system for a multi-lobed piston of a trochoidal rotary engine having a housing in which the piston is rotatable and which defines with a peripheral edge of the piston a plurality of working chambers each having a combustion chamber; the piston side seal system comprising an elongate, resilient metal seal means, biasing means and cam means by which the biasing means is co-operable with the seal means; wherein the biasing means is adapted for lateral location in a peripheral side seal groove which is formed in a side face of the piston and which is located adjacent, and substantially parallel, to the peripheral edge of the piston; the biasing means comprises an elongate undulating spring; the cam means is adapted for lateral location in the peripheral side seal groove after said location of the biasing means and comprises an elongate, metal member; the seal means is in the form of an elongate ribbon, having first and second opposite side edges, and is adapted for lateral location in the peripheral side seal groove of the piston after said location of the cam means whereby, in use, the first edge of the seal means is within said groove and the second edge of the seal means faces and provides a seal with a side plate surface of a side plate of the engine housing under the action of a force applied by the biasing means to the cam means to urge said seal means outwardly with respect to the groove; the seal means is formed of two elongate seal members each in the form of an elongate ribbon and each having first and second side edges, the first edge of each seal member forms a respective part of the first edge of the seal means and the second edge of the seal means is defined by the second edge of at least one of the two seal members; each seal member defines a respective, longitudinally extending bevelled surface with the bevelled surfaces mutually inclined to provide a V-shaped formation in which the biasing means is received; wherein the seal means is engaged by the cam means at each bevelled surface whereby, when the force is applied at each bevelled surface by the cam means under the action of the biasing means, the force is resolved in each seal member into a first component which acts to achieve the sealing of the second edge of the seal means with the side plate surface of the engine housing and a second component which acts to urge each seal member into engagement with a respective side of the piston groove to provide a gas seal between each seal member and that respective side of the groove; and wherein the second edge of the seals means is defined by the second edge of only one of said elongate seal members whereby the second edge of said one seal member is adapted to face and provide a seal with said side plate surface of the engine housing.

14. A piston side seal system for a multi-lobed piston of a trochoidal rotary engine having a housing in which the piston is rotatable and which defines with a peripheral edge of the piston a plurality of working chambers each having a combustion chamber; the piston side seal system comprising an elongate, resilient metal seal means, biasing means and cam means by which the biasing means is co-operable with the seal means; wherein the biasing means is adapted for lateral location in a peripheral side seal groove which is formed in a side face of the piston and which is located adjacent, and substantially parallel, to the peripheral edge of the piston; the biasing means comprises an elongate, undulating spring; the cam means is adapted for lateral location in the peripheral side seal groove after said location of the biasing means and comprises an elongate metal member; the seal means is in the form of an elongate ribbon, having first and second opposite side edges, and is adapted for lateral location in the peripheral side seal groove of the piston after said location of the cam means whereby, in use, the first edge of the seal means is within said groove and the second edge of the seal means faces and provides a seal with a side plate surface of a side plate of the engine housing under the action of a force applied by the biasing means to the cam means to urge said seal means outwardly with respect to the groove; the seal means is formed of an elongate seal member in the form of an elongate ribbon and having first and second side edges, the first edge of the seal member forms the first edge of the seal means and the second edge of the seal means is defined by the second edge of the seal member; the first edge of the seal member defines a longitudinally extending bevelled surface which is inclined with respect to one of opposed sides of the groove to provide between the bevelled surface and the one side of the groove a V-shaped formation in which the cam means is received and wherein the seal means is engaged by the cam means at such bevelled surface whereby, when the force is applied to the bevelled surface, by the cam means under the action of the biasing means, the force is resolved in the seal member into a first component which acts to achieve the sealing of the second edge of the seal means with the side plate surface of the engine housing and a second component which acts to urge the seal member into engagement with the other side of the piston groove to provide a gas seal between the seal member and that other side of the groove.

15. A piston and side seal assembly for a trochoidal rotary engine, the assembly including:

(a) a multi-lobed piston mountable for rotation in an engine housing which defines with a peripheral edge of the piston a plurality of working chambers each having a combustion chamber, the piston defining in each of opposite side faces thereof a respective peripheral side seal groove which is located adjacent, and substantially parallel to the peripheral edge whereby a respective portion of each groove extends around each lobe of the piston; and (b) a respective piston side seal system for each portion of each groove, each side seal system comprising an elongate, resilient metal seal means, biasing means, and cam means by which the biasing means is co-operable with the seal means;

wherein, for the respective side seal system for each portion of each side seal groove:

(i) the biasing means is adapted for lateral location in the side seal groove portion and comprises an elongate, undulating spring;

(ii) the cam means is adapted for lateral location in the peripheral side seal groove portion after said location of the biasing means and comprises an elongate, metal member;

(iii) the seal means is in the form of an elongate ribbon, having first and second opposite side edges, and is adapted for lateral location in the side seal groove portion after said location of the cam means whereby, in use, the first edge of the seal means is within said groove portion and the second edge of the seal means faces and provides a seal with a side plate surface of a side plate engine housing under the action of a force applied by the biasing means to the cam means to urge said seal means outwardly with respect to the groove portion;

(iv) the seal means is formed of an elongate seal member in the form of an elongate ribbon and having first and second side edges, the first edge of the seal member forms the first edge of the seal means and the second edge of the seal means is defined by the second edge of the seal member;

(v) the first edge of the seal member defines a longitudinally extending bevelled surface which is inclined with respect to and faces one of opposed sides of the groove portion to provide between the bevelled surface and the one side of the groove portion a V-shaped formation in which the cam means is received; and (vi) the seal means is engaged by the cam means at said bevelled surface whereby, when the force is applied to the bevelled surface by the cam means under the action of the biasing means, the force is resolved in the seal member into a first component which acts to achieve the sealing of the second edge of the seal means with the side plate surface of the engine housing and a second component which acts to urge the seal member into engagement with the other of the opposed sides of the groove portion to provide a gas seal between the seal member and that other side of the groove portion.

16. A trochoidal rotary engine including a piston and side seal assembly as defined by claim 15, and further including a respective inter-lobe groove seal adjacent ends of successive piston side seal systems, each of which groove seals substantially prevents gas pressure in one groove portion from being transmitted to another adjacent groove portion; wherein each groove seal includes a bracket locatable in a cut-out formed in one end of the seal means of one of the adjacent side seal systems and in a recess defined by a short length of the piston groove adjacent to a waist of the piston, with the groove at said recess having an increased depth; the bracket of each groove seal providing a sealing fit between each side of the groove and further providing sealing contact with a bottom surface of the groove and the cut-out in the seal means.

17. A trochoidal rotary engine including a piston and side seal assembly as defined by claim 15, and further including a respective inter-lobe groove seal adjacent ends of successive piston side seal systems, each of which substantially prevents gas pressure in one groove portion from being transmitted to another adjacent groove portion; wherein each groove seal includes a resilient groove seal member which fits firmly in the piston groove and which inter-fits with a cut-out at or adjacent to one end of the seal means of one of adjacent side seal systems, adjacent to a waist of the piston; the resilient groove seal member of each groove seal providing a sealing fit between each side of the groove and further providing a sealing fit between a bottom surface of the groove and the seal means.

* * * * *